United States Patent [19]

Rek

[11] Patent Number: 4,556,504

[45] Date of Patent: Dec. 3, 1985

[54] AQUEOUS ALKALINE LIQUID DETERGENT COMPOSITION

[75] Inventor: Johannes H. M. Rek, Vlaardingen, Netherlands

[73] Assignee: Lever Brothers Company, New York, N.Y.

[21] Appl. No.: 592,039

[22] Filed: Mar. 21, 1984

[30] Foreign Application Priority Data

Mar. 25, 1983 [GB] United Kingdom ..... 8308263

[51] Int. Cl.[4] ..... C11D 3/06; C11D 3/37

[52] U.S. Cl. ..... 252/135; 252/156; 252/174.21; 252/174.23; 252/DIG. 2; 252/DIG. 14; 252/527; 252/174.24; 252/174.25

[58] Field of Search ..... 252/156, 135, 174.21, 252/174.23, DIG. 2, DIG. 14

[56] References Cited

U.S. PATENT DOCUMENTS 3,060,124 10/1962 Ginn ..... 252/135
3,168,478 2/1965 Stefcik et al. ..... 252/156
4,215,004 7/1980 Borgerding et al. ..... 252/156
4,226,736 10/1980 Bush et al. ..... 252/135
4,228,048 10/1980 Tesdahl ..... 252/DIG. 2
4,421,680 12/1983 Shivar ..... 252/DIG. 14

*Primary Examiner*—Prince E. Willis
*Assistant Examiner*—Hoa Van Le
*Attorney, Agent, or Firm*—Lynne Darcy; James J. Farrell

[57] ABSTRACT

The invention relates to aqueous built liquid detergent compositions of high alkalinity comprising at least 2% by weight of an alkoxylated fatty alcohol or mixture thereof having an overall ratio between the number of ethylene oxide units and propylene- and/or butylene oxide units of less than 9; from 2 to 30% by weight of an alkaline agent; from 5 to 35% by weight of a detergency builder and from 0.1 to 1.0% by weight of an essentially single structuring polymeric agent; the composition having a pH equal to or above 11. The detergent compositions, which are suitable for both fabric- and dish-washing, show good detergency and stability, and improved viscosity and pourability.

12 Claims, No Drawings

AQUEOUS ALKALINE LIQUID DETERGENT COMPOSITION

The inventioon relates to built liquid detergent compositions. More in particular the invention relates to aqueous alkaline built liquid detergent compositions with improved rheologic properties.

Aqueous alkaline built liquid detergent compositions for use in fabric- or dishwashing machines are well known. Theyare often considered to be more convenient to the user than the equivalent dry powdered or particulate products, as they are easier to dose, dissolve more readily, are non-dusting and usually occupy less storage space. Their formulation, however, is difficult since, on the one hand, considerable quantities of builder salts and alkaline agents should be incorporated to provide consumer-satisfactory detergency and, on the other hand, liquid products should be stable under a wide range of storage conditions and should have good pourability for consumer convenience.

In the prior art the problem of incorporating adequate quantities of e.g. inorganic builder salts in a liquid detergent has been approached by providing liquid suspending media, which are able to support the undissolved part of the builder salt in the liquid in a semi-permanent way.

Although by internal or external structuring it has been possible to formulate liquid media capable of suspending adequate amounts of such undissolved or less soluble builders, hitherto it has proved difficult to formulate compositions of high alkalinity, which results from the use of alkaline builder salts or alkaline agents, such as silicates or sodium hydroxide, without a very negative effect on the viscosity behaviour and physical or chemical stability.

Accordingly it is an object of the invention to provide stable suspending built liquid detergent compositions of high alkalinity, which have a good pourability and viscosity behaviour.

It is a further object of the present invention to provide such compositions in which the surface-active system is primarily based on nonionic detergents.

In the German Patent application No. 3,006,333 such alkaline liquid detergent composition is disclosed comprising a nonionic detergent and a suspending system on the basis of a combination of sodium polyacrylate and modified polyacrylic acid. It was observed that compositions formulated according to the above disclosure without careful selection of the nonionic detergent in general showed unacceptably high viscosity and therefore poor pourability.

It has now been found that a highly alkaline liquid detergent composition can be formulated which comprises considerable levels of detergency builders and alkaline agents, comprising an alkoxylated fatty alcohol nonionic detergent or mixture of such nonionic detergents having an over-all ratio between the number of ethylene-oxide units and propylene- and/or butylene oxide units of less than 9, and an essentially single structuring agent of the cross-linked polyacrylate type.

By way of the invention compositions are obtained which combine the advantages of high alkalinity, stability, good viscosity and pourability and easy formulating.

Accordingly, the present invention provides an alkaline built liquid detergent composition which comprises in an aqueous medium:

(a) at least 2% by weight of an alkoxylated fatty alcohol nonionic detergent or mixture thereof having in the alkylene oxide radical an over-all ratio between the number of ethylene-oxide units and the propylene- and/or butylene-oxide units of less than 9;

(b) from 2 to 30% by weight of an alkaline agent;

(c) from 5 to 35% by weight of a detergency builder; and (d) from 0.1 to 1.0% by weight of an essentially single structuring polymeric agent; the composition having a pH equal to or above 11.

An essential feature of the present invention is the specific selection of the nonionic detergent, which is of the fatty alcohol type being condensed with a mixture of ethylene-oxide and propylene-oxide and/or butylene-oxide. It is necessary to select the alkoxylated fatty alcohol or mixture thereof such that the over-all ratio between the number of ethylene-oxide units and the propylene- and/or butylene-oxide units is below 9, preferably below 2.5 or even 1.8. The term "over-all ratio" refers to the fact that either a single alkoxylated alcohol may be used having in its alkylene-oxide radical a suitable ratio of ethylene-oxide to propylene- and/or butylene-oxide units or a mixture of alkoxylated alcohols may be used having a suitable ratio only on an average.

The nonionic detergent is normally present in an amount of at least 2% and in particular of at least 5% by weight, the amount preferably ranging from 5 to 15% by weight of the total composition.

Nonionic detergents for use in compositions of the present invention can be readily obtained commercially, such at e.g. those sold under the trade names Lutensol LF 400 to 1300 (ex BASF AG) and Plurafac RA 30 to 343 (ex Produits Chimiques Ugine-Kuhlmann)

The nonionic detergent can be used as sole detergent but other detergent-active ingredients, such as e.g. the water-soluble anionic asulphate or sulphonate detergents, can be tolerated provided their amount does not exceed 5% by weight, preferably 3% by weight or even 1% by weight of the total composition.

The alkaline agent is in general present in an amount of from 2% to 30% by weight, preferably 10 to 25% by weight of the total composition. Examples of suitable agents are the alkalimetal hydroxides and silicates, such as alkalimetal orthosilicates, metasilicates and disilicates, sodium meta-silicate being rpreferred.

Also mixtures of alkaline agents may be used, such as a combination of sodium silicate and sodium hydroxide.

The compositions of the invention contain 5% to 35%, in particular 10% to 30% and preferably 10% to 25% by weight of a detergency builder. Typical examples of suitable detergency builders are the phosphate builders such as the alkalimetal salts of triphosphoric acid, pyrophosphoric acid, orthophosphoric acid, polymetaphosphoric acid and mixtures thereof. Sodium and potassium triphosphates are preferred. Other suitable builders include carbonates, zeolites and organic builders such as citrates and polycarboxylates such as nitrilotriacetate, and the mixtures thereof.

The present compositions are externally structured and for this purpose they contain an essentially single structuring or thickening polymeric agent. Suitable agents are found among the alkali-stable polymers. Especially suitable are the water-soluble polymers of acrylic acid, cross-linked with about 1% of a polyallyl ether of sucrose having an average of about 5.8 allyl groups for each sucrose molecule, the polymer having a molecular weight in excess of 1.000.000. Examples of such polymers are Carbopol 934, 940 and 941. Carbopol is the Registered Trademark of B.F. Goodrich Co. Ltd., the manufacturers of these polymers. The preferred polymer is Carbopol 941. Depending on the viscosity which is desired they may be included in the range of from 0.1% to 1% by weight, but preferably their amount varies from 0.2% to 0.8% by weight, and in particular from 0.2 to 0.6% by weight of the total composition.

The liquid detergent composition of the invention may further contain any of the adjuvants normally used in fabric-washing detergent compositions, e.g. sequestering agents such as ethylenediaminetetraacetate and diethylenetetraamine methylene phosphoric acid; soil-suspending and anti-redeposition agents such as carboxymethylcellulose, polyvinylpyrrolidone and the maleic anhydride/vinylmethylether copolymer; fluorescent agents; hydrotropes; conditioning agents; lather boosters; perfumes, germicides and colourants.

Further the addition of lather-depressors such as liquid polysiloxane anti-foam compounds; alkaline stable enzymes; bleaches, such as e.g. sodium sulphite, and potassium dichlorocyanaurate, may be necessary or desirable to formulate a complete heavy-duty detergent composition suitable for use in machine washing operations. These ingredients can be employed in the liquid detergent without the risk of undue decomposition during storage, especially if a proper protective coating is applied.

Compositions of the present invention normally have viscosities within the range of 0.3 to 3.0 Pa.s (at 20° C. and 20 $sec^{-1}$.), in particular within the range of 0.5 to 3.0 Pa.s and preferably within the range of 0.6–1.2 Pa. s.

Compositions of the present invention are especially advantageous having pH-values within the high alkalineregion, in particular values equal to or above 11, but preferred are pH-values above 12 or even about 13.

The invention will be further illustrated in the following examples. All percentages used therein are by weight unless otherwise specified.

EXAMPLES 1-5

The following compositions were prepared;

TABLE 1

| Ingredients | ex. 1 | ex. 2 | ex. 3 | ex. 4 | ex. 5 | ex. 6 | ex. 7 |
|---|---|---|---|---|---|---|---|
| | weight percentages | | | | | | |
| Lutensol LF 403 | 10 | 10 | 10 | 10 | 10 | 2.5 | 2.5 |
| Sodium ($C_{12}$) alkylbenzene sulphonate | — | — | 0.1 | 0.1 | — | 0.1 | 0.1 |
| Potassium triphosphate | — | — | — | — | 12 | — | — |
| Sodium triphosphate | 10 | 10 | 10 | 10 | — | 24.6 | 17.1 |
| Sodium metasilicate | 20 | 20 | 20 | 8 | 20 | — | — |
| Carbopol 941 | 0.4 | 0.2 | 0.3 | 0.5 | 0.5 | 0.5 | 0.5 |
| Sodium hydroxide | — | — | — | 8 | — | 15 | 15 |
| Optical brightener | — | — | — | 0.2 | 0.2 | — | — |
| water | | | | balance | | | |
| pH | | | | 14 | | | |

Viscosity results are present in Table 2,

TABLE 2

| Time after preparation | viscosity in Pa · s (at 20° C., 20 $sec^{-1}$) | | | | | | |
|---|---|---|---|---|---|---|---|
| | ex. 1 | ex. 2 | ex. 3 | ex. 4 | ex. 5 | ex. 6 | ex. 7 |
| fresh | 1.1 | 0.9 | 0.7 | 1.0 | 0.9 | 1.5 | 1.6 |
| 1 week | 1.2 | 0.8 | 0.6 | 1.2 | 1.1 | 1.5 | 1.9 |

TABLE 2-continued

| Time after preparation | viscosity in Pa · s (at 20° C., 20 $sec^{-1}$) | | | | | | |
|---|---|---|---|---|---|---|---|
| | ex. 1 | ex. 2 | ex. 3 | ex. 4 | ex. 5 | ex. 6 | ex. 7 |
| 1 month | 1.1 | 0.6 | 0.6 | 1.2 | 1.1 | 1.5 | 1.9 |
| 2 months | 1.2 | 0.7 | 0.7 | 1.2 | 1.1 | 1.5 | 1.9 |

All example compositions showed excellent stability under a wide temperature range (−5°, 22° C., 37 C.) for at least two months. The compositions also remained stable during 10 freeze/thaw cycles (between −5° C. and 22° C.) of 48 hours each.

I claim:

1. A suspending alkaline built liquid detergent composition having improved rheologic properties consisting essentially of:

(a) from 2 to 15% by weight of nonionic detergent selected from the group of polyalkoxylated fatty alcohols having in the polyalkylene-oxide radical ethylene oxide units and propylene and/or butylene oxide units wherein the overall ratio between the number of ethylene oxide units and the number of propylene and/or butylene oxide units is less than 9;

(b) from 2 to 30% by weight of an alkaline agent selected from the group consisting of alkali metal hydroxides, alkali metal orthosilicates, alkali metal metasilicates, alkali metal disilicates, and mixtures thereof;

(c) from 5 to 35% by weight of a detergency builder selected from the group consisting of the alkali metal salts of triphosphoric acid, pyrophosphoric acid, orthophosporic acid, polymetaphosphoric acid, mixtures of said salts of said acids, carbonates, zeolites, citrates, nitrilotriacetate , and mixtures thereof; and p0 (d) from 0.1 to 1.0% by weight of a single structuring polymeric agent selected from the group of cross-linked polyacrylates; and (e) water;

wherein said composition has a pH equal to or greater than 11 and a viscosity within the range of 0.3 to 3.0 Pa.s at 20° C. and 20 sec-1.

2. A composition according to claim 1 comprising from 10 to 25% by weight of said detergency builder.

3. A composition according to claim 1 wherein the nonionic detergent has a ratio between the number of ethylene-oxide units and the number of propylene- and-/or butylene-oxide units of less than 2.5.

4. A composition according to claim 1 wherein the nonionic detergent has an ratio between the number of ethylene-oxide units and the number of propylene- and-/or butylene-oxide units of less than 1.8.

5. A composition according to claim 1 comprising from 5 to 15% by weight of the nonionic detergent.

6. A composition according to claim 1 comprising from 10 to 25% by weight of the alkaline agent.

7. A composition according to claim 1 wherein the alkaline agent is sodium metasilicate.

8. A composition according to claim 1 wherein the detergency builder is sodium and/or potassium tripolyphosphate.

9. A composition according to claim 1 comprising from 0.2 to 0.6% by weight of the structuring agent.

10. A composition according to claim 1 having a pH value equal to or above 12.

11. A composition according to claim 1 having a pH value equal to or above 13.

12. A composition according to claim 1 having a viscosity of between 0.6 to 1.2 Pa.s measured at 20° C. in 20 $sec^{-1}$.

* * * * *